United States Patent [19]

Ressi di Cervia

[11] Patent Number: 4,877,358

[45] Date of Patent: Oct. 31, 1989

[54] METHOD AND APPARATUS OF CONSTRUCTING A NOVEL UNDERGROUND IMPERVIOUS BARRIER

[75] Inventor: Arturo L. Ressi di Cervia, New York, N.Y.

[73] Assignee: Finic, B.V., Rotterdam, Netherlands

[21] Appl. No.: 303,046

[22] Filed: Jan. 30, 1989

Related U.S. Application Data

[63] Continuation of Ser. No. 252,676, Apr. 9, 1984, abandoned.

[51] Int. Cl.[4] ..... E02D 29/00

[52] U.S. Cl. ..... 405/267; 405/258; 405/128; 405/270

[58] Field of Search ..... 405/109, 115, 155, 157, 405/176, 267, 258, 266

[56] References Cited

U.S. PATENT DOCUMENTS

| | | | |
|---|---|---|---|
| 1,997,132 | 4/1935 | Collorio | 405/109 |
| 2,048,710 | 7/1936 | Ranney | 405/267 |
| 3,197,964 | 8/1965 | Fehlmann et al. | 405/267 |
| 3,310,952 | 3/1967 | Veder | 37/193 X |
| 3,603,099 | 9/1971 | Zakiewicz | 405/157 |
| 3,759,044 | 9/1973 | Caron et al. | 405/267 |
| 4,193,716 | 3/1980 | Piccagli | 405/267 |
| 4,194,855 | 3/1980 | Egger | 405/128 |
| 4,335,978 | 6/1982 | Mutch | 405/129 |
| 4,337,006 | 6/1982 | Lacey | 405/176 |
| 4,352,601 | 10/1982 | Valiga et al. | 405/270 |
| 4,358,221 | 11/1982 | Vickberg | 405/128 |

FOREIGN PATENT DOCUMENTS

| | | | |
|---|---|---|---|
| 1484456 | 11/1969 | Fed. Rep. of Germany | 405/267 |
| 1915688 | 3/1970 | Fed. Rep. of Germany . | |

*Primary Examiner*—Dennis L. Taylor
*Attorney, Agent, or Firm*—Jim Zegeer

[57] ABSTRACT

A novel underground impervious barrier is constructed by excavating a trench or slot along the desired line of the impervious barrier in the presence of a bentonite slurry. A double layered plastic film or sheet joined or folded at the bottom of the trench to form a sheath or envelope and open at the top and of sufficient vertical extent to extend above the ground and drape on both sides of the trench is installed in the trench and as the plastic sheath or envelope is installed in the trench it is hydraulically backfilled between the two facing surfaces thereof with a backfilling material having a greater density than the density of the bentonite slurry to sink the double layer plastic film or sheet to the bottom of the trench and displace the bentonite slurry forward in the trench toward the end being excavated. The impervious barrier constructed is constituted by the areas of the earth on the two facing side walls of the trench which are permeated by bentonite, each side wall having a bentonite cake contiguous thereto, a plastic membrane contiguous to the outer surface of the bentonite cake and the backfill material between the facing surfaces of the plastic membrane. Such a barrier is very useful for pollution control, for imponding water and/or otherwise effectively impeding horizontal flow of pollutants, water, oil and other flowable and/or substances leachable through the earth materials.

5 Claims, 2 Drawing Sheets

METHOD AND APPARATUS OF CONSTRUCTING A NOVEL UNDERGROUND IMPERVIOUS BARRIER

This application is a continuation, of application Ser. No. 252,676, filed Apr. 9, 1981, now abandoned.

This invention is directed to a method and apparatus for constructing a novel underground impervious fluid barrier which is useful for pollution control, impounding water, oil and other flowable material, especially in populated areas, where government and industries are faced with the problem of arresting underground seepages and situations where there is little or no gradient between the outside water table and the polluted area inside.

BACKGROUND AND BRIEF DESCRIPTION

Lining underground slurry trenches with impervious films such as rubber liners, plastic sheets, foils and the like has been attempted prior to this invention but they have not been particularly successful. (See page 130 of R. G. H. Boyers' text entitled "Strutural and Cut-Off Diaphragm Walls" John Waley & Sons). In Ranney Pat. No. 2,048,710, an apparatus is disclosed for constructing an underground wall in which two rolls of lining material are carried inside wings of an excavating shield for unrollling the lining material to line the walls of the trench preparatory to filling of the trench with the desired wall material. There is no teaching in Ranney of utilizing a lining material which is folded (or otherwise joined) at the bottom and of sufficient height to comfortably drape over the sides of the trench. A feature of the process of the present invention is the use of the fill material to weight the lining material and displace the bentonite (using the lining material to transmit the displacing force to the bentonite). In Zaklewicz Pat. No. 3,603,099 and Caron et al Pat. No. 3,759,044, a plastic sheet is immersed in a bentonic mud filled trench. In the Zaklewicz patent the filling material is added to each side of the plastic membrane to displace the excavating slurry and in the Caron et al patent, the plastic sheeting is immersed in a cementious bentonite filled trench and remains there until the wall material has set. Neither of these prior art references disclose the concept of applicant's double or folded plastic membrane nor is there disclosed a membrane of sufficient vertical height to drape over the sides of the trench. In the present invention, the double layer end fold results in a basic wall structure not disclosed in these prior art references.

The use of the lining for protecting underground pipes and conduits has been known in the art as is disclosed in Grodsky Patent No. 2,007,969 and in Keene Pat. No. 3,675,432. However, these are non-analogous to the present invention and neither of these is disclosed in the context of a slurry trench excavating process and obviously, do not in any sense teach the depth of the wall and process as disclosed herein and do not teach or suggest a membrane of 30 to 40 feet in depth containing industrial pollutants or impounding water or other flowable materials. In Grether et al Pat. Nos. 3,298,183 3,218,810 and 3,182,459, a fluid barrier is disclosed for water impoundment and/or channelization but there is no underground structure contemplated, and the double folded material is simply folded at the top above the ground and burried to anchor same against the force of the upstream water.

The basic object of the present invention is to provide an improved impervious underground wall structure and an improved method and apparatus for constructing same, particularly for pollution control.

A basic feature of the invention is that the liner is a folded plastic liner (forming a sheath or envelope for the backfill material) of sufficient height so that both sides thereof can extend and drape over the sides of the slurry filled trench so that the backfill material, which, preferrably, is hydraulically placed and of greater density than the slurry in the trench, carries the fold line to the bottom of the trench and displaces the bentonite slurry towards the end of the excavation where the excavation is taking place thereby reducing the amount of slurry needed. The double layer plastic is unrolled along the trench, the end extending up above the surface is opened up and the backfill material is hydraulically placed between the sheets. Typically the backfill material may be a mixture of sand and water which will have two effects. It will sink the plastic to the very bottom of the trench and make it adhere to the sides of the trench and will displace forward the bentonite, reducing the need for a lot of bentonite for excavation. The wall structure resulting from this technique is novel in that the impervious barrier that is constructed in the earth will consist of an area of soil adjacent the excavation which has been permeated by bentonite (e.g. the side walls of the trench), a bentonite cake, the plastic membrane, the backfill material inside the plastic membrane (typically sand or coarse grannular material) and the same system repeated again on the opposite trench wall side.

The advantages of the system are that it assures an absolute water tightness by two identical pollutant barrier systems in series,—the soil permeated bentonite, the bentonite cake and the plastic membrane. Moreover, the backfill material is used to sink the plastic sheath or envelope to the bottom of the trench, hence, once the initial insertion in the trench of the roll and a preliminary backfilling is accomplished, the plastic material is unrolled or unfolded from an accordion fold and floats in the trench or slot until it is opened up at the top and the backfill material is inserted and the bentonite slurry is displaced to the opposite end of the trench or slot.

BRIEF DESCRIPTION OF THE DRAWINGS

The above and other objects, advantages and features of the invention will become more apparent from the following specification taken in conjunction with the accompanying drawings wherein.

Figure 1:
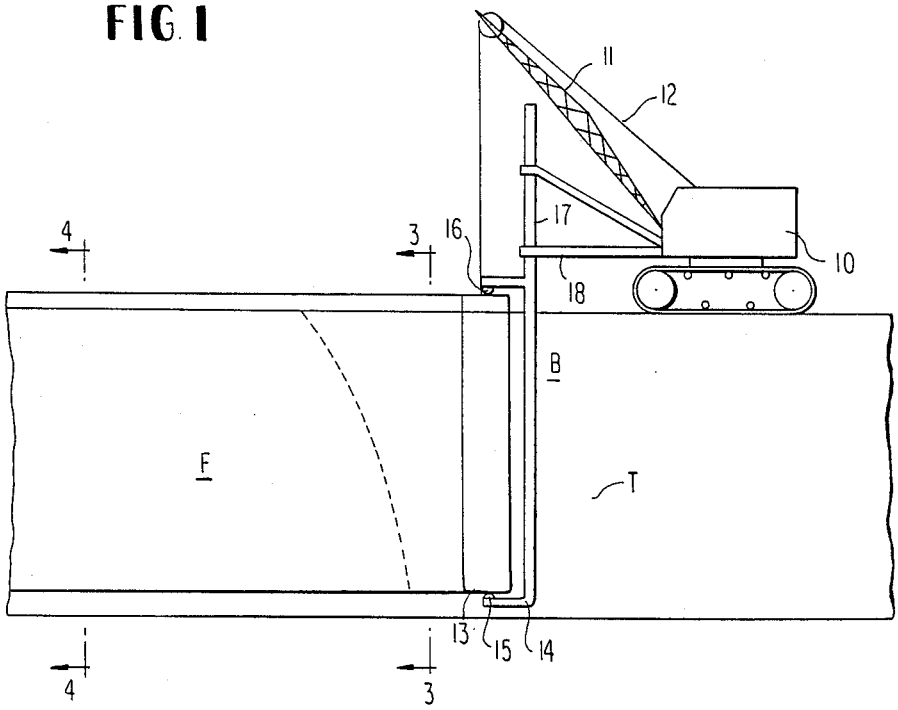
FIG. 1 is a sectional elevational view of an excavation illustrating one embodiment of the invention.

The basic method of this invention for constructing an underground pollution control barrier comprises excavating a narrow trench or slot along the desired line of the pollution control barrier in the presence of a bentonite slurry. It will be appreciated that while bentonite is the preferred slurry, other materials which perform the same function as the bentonite slurry may be used but bentonite slurry is preferred since it can be closely tailored to have the property of permeating the soil adjacent and contiguous to the excavation to form a first barrier to the polluting substance. In addition, a bentonite cake forms on the wall during the excavating process to serve as a second barrier to the flow of any polluting substances. After forming the initial trench excavation or slot and while the trench is full of the slurry maintaining it open in the way disclosed in Veder Pat. No. 3,310,952, a sheath or envelope constituted by a double layered plastic membrane which is folded at the bottom of the trench and open at the top and of sufficient vertical extent to extend above the ground surface on both sides of the trench, is inserted into the trench or slot. The trench or slot T in FIG. 1 has been excavated by clam shell, backhoe, trenching apparatus and the like, to the desired depth of the barrier. Typically, this invention will apply to depths of 30 to 40 feet and, in the usual case about 20 feet or down to the water table level. In the illustrated embodiment, the trench T is filled with a bentonite slurry B to the top of the trench slot all in accordance with the teachings of Veder Pat. No. 3,310,952, incorporated herein by reference. A portion of the loading by the lifting and placing devices 10 may be transferred to the slurry by the use of the slurry float technique as disclosed in my application Ser. No. 173,538. Lifting and placing device 10 has a boom 11 carrying control cables 12 to a plastic film pay out roll 13. A frame 14 having bearings 15 and 16 for roll 13 is maintained in vertical relation by stabilizing members 17 and 18 extending from lifting and placing device 10. The plastic film F (forming the backfill sheath or envelope) which, under certain circumstances can be reinforced or complemented by a woven fabric WF to give it additional strength, is capable of withstanding the stress and avoidance of possible tears.

After the formation of the initial trench portion, the end of the sheath or envelope constituted by the plastic film F is opened up and each of the ends is draped over the sides of the trench so that the fold line lies in approximately the center of the trench. In this sense, the end then will be floating on the bentonite layer and at this time, the backfill material has begun to be hydraulically placed between the sheets of plastic. Typically, a mixture of sand and water can be used which will have two effects. It will sink the plastic to the bottom of the trench or slot and make it adhere to the sides of the trench and will also displace the bentonite slurry forward in the trench by the force exited through the plastic layers thereby reducing the need for a lot of bentonite for the excavation. On the other hand, the end of the trench can be sealed and with a rigid bar member forcing the end of the envelope down to the bottom of the trench and then the envelope or sheath is filled with the backfill material as described. Of course, the end of the sheath can be heat sealed along a vertical line joining the two sides, if desired.

By using a course granular material as a fill within the plastic, a very pervious layer enclosed in plastic can act as a filter. Draining the filter material is an excellent method of maintaining the effectiveness of the barrier and, with a minimum amount of pumping by pump P (FIG. 5) at long intervals, guaranteeing that any pollutant which crosses the initial barrier is collected and eliminated.

Figure 2:
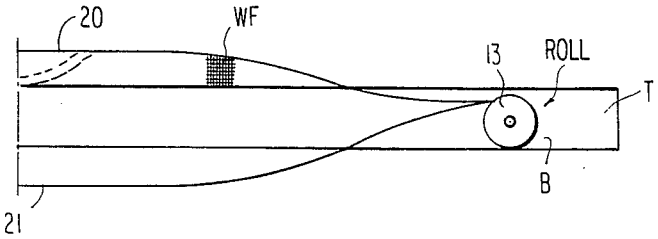
FIG. 2 is a top plan view of the trench illustrated in FIG. 1.
Figure 3:
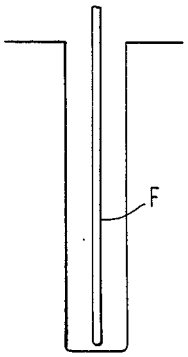
FIG. 3 is a sectional view taken on the lines 3—3 of FIG. 1 illustrating the folded plastic sheet, sheath or envelope liner prior to being filled with a backfill material.

In FIG. 3, the plastic film is shown as it is being unrolled from roll 13. As shown in the top plan view of FIG. 2, the ends 20, 21 of the plastic film are draped over the surface above the side walls of the trench. The bentonite slurry B in trench T exerts a hydraulic head on the sides of the plastic film which is immersed thereby forcing any air out of the construction. Thus, the hydraulic placement of the backfill material applies a pressure against the inside surfaces of the plastic film thereby forcing and displacing the bentonite slurry towards the excavating end of the trench thereby reducing the amount of bentonite required to perform the excavation.

It will be appreciated that the excavating slurry can in fact by a cementious bentonite mixture and the backfill material 30 can itself be a self-hardening substance such as a cement-bentonite mixture.

When the end of the roll 13 is approached, the backfilling is withheld for a distance of approximately 50 feet. The roll 13 is then lifted out of the excavation and the remaining portions completely unrolled and washed of bentonite material and laid flat. A second roll is then placed on the carrier and its end unrolled and two ends are then welded together using conventional plastic sheet welding. For example, R.F. Welding or other heat seam welding can be utilized to join the end of the new roll to the end of the old roll. The new roll is then lowered back into the trench of slot T and the backfilling operation resumes along with the excavating of the forward end of the trench.

In this regard, instead of the roll being vertical and instead of a fold at the bottom of the trench, the roll is not folded but is simply rolled along the top of the trench so that it floats on the bentonite slurry. The ends of the roll extend quite some distance beyond the edges of the excavation and the end of the roll is then pushed to the bottom of the trench either by the backfill material or by a rigid rod and the backfilling operation commenced. In this case, the roll per se never goes below the surface but the ends thereof is open and clear for performing the welding operation to add the next roll on.

Larger rolls can be accomodated by varying the thickness of the trench along the line of the barrier. Thus, as the roll is payed out, the trench can be made narrower, this approach having the advantage of permitting longer rolls and minimizing the number of joints.

Figure 4:
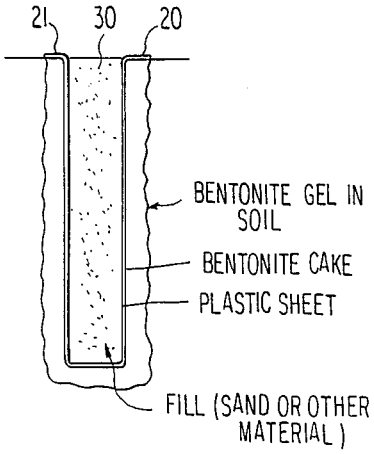
FIG. 4 is a sectional view taken on lines 4—4 of FIG. 1 illustrating the plastic sheet, sheath or envelope liner after it has been filled with backfill material.
Figure 5:
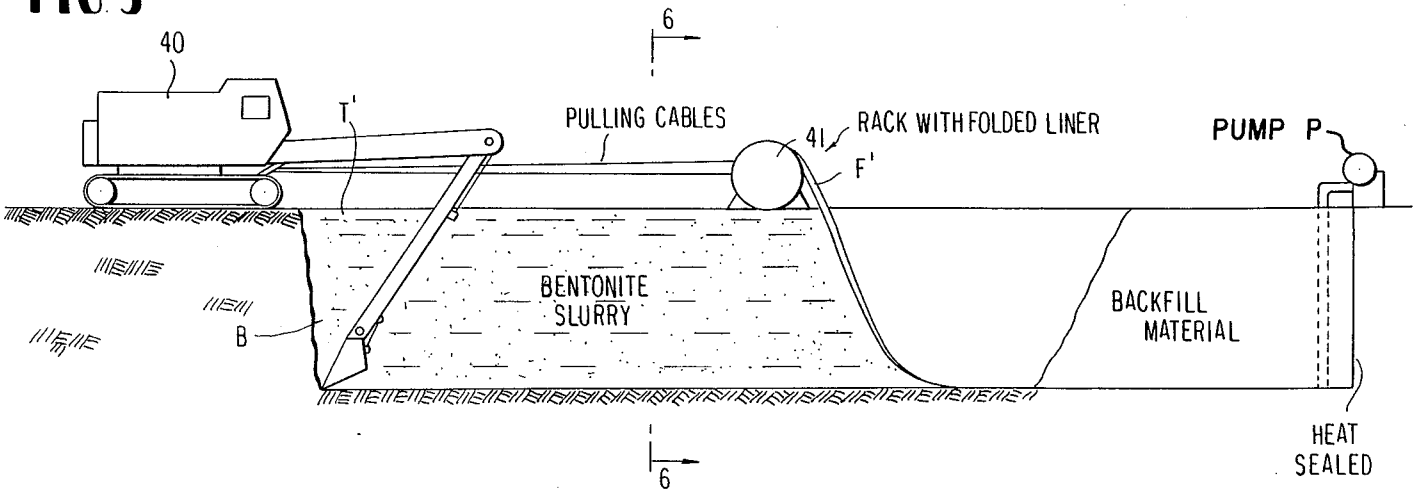
FIG. 5 is a sectional elevational view of a further embodiment of the invention illustrating the plastic liner being fed into the trench from a rack with an accordion folded liner.
Figure 6:
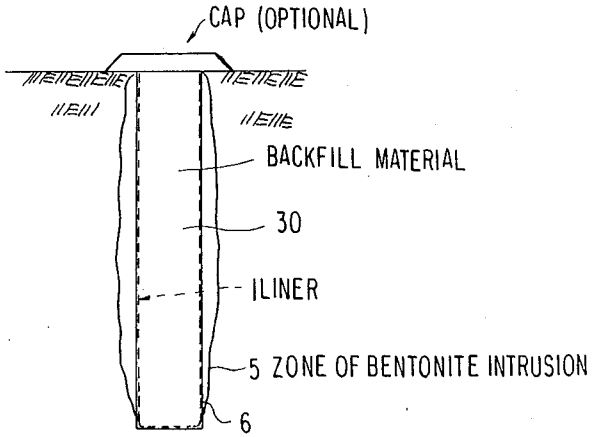
FIG. 6 is a sectional view taken on lines 6—6 of FIG. 5.

Referring now to FIG. 5, a backhoe excavator 40 is shown excavating the trench or slot T' which is maintained full of bentonite slurry B. A rack 41 with an accordion folded liner F' is coupled by pulling cables or a draw bar to backhoe 40. In this method, the laying of the plastic comprises in folding it up accordion style in a large roll above ground with the backfill material opening up the folds and pushing the plastic down into the trench as illustrated in FIG. 5. The joining of the ends of the film F' is a new roll to the old roll does not thereby require the removing of the expended roll as in the embodiment of FIG. 1. As shown in FIG. 6, there is as in the case of FIG. 4, a bentonite jell of a zone of bentonite intrusion 5, a bentonite cake 6 and plastic layer or sheet 7 on each side of the trench and the backfill material of sand, gravel etc. It will be appreciated that the plastic film can be payed out from a pair of parallel rolls and prior to entry to the trench heat sealed or otherwise bonded at the lower edges of the two rolls to form the joint that will eventually be at the bottom of the trench.

Thus, there has been disclosed an improved process and apparatus for constructing a novel impermeable membrane of 30 to 40 feet in depth which is particularly useful for containing areas of industrial pollutants and arresting underground seepage where there is little or no gradient between the outside water table and the polluted area inside. Moreover, the invention has applicability to forming water and petroleum impoundments, cut-off walls and water channelization at relatively high rate of installation and at relatively low cost.

While I have disclosed several embodiments of the invention and suggested other modifications, it will be apparent that many modifications which will be obvious to those skilled in the art and it is intended that such modifications be encompassed within the spirit and scope of the claims appended hereto.

I claim:

1. An underground fluid material flow control barrier comprising, (1) a narrow slot in the earth having a length extending across the expected flow path of said material, said slot having a depth extending at least to the water table, (2) bentonite impregnating the earth walls of said slot and forming a bentonite cake on the inner surfaces thereof, (3) a pair of flexible plastic sheets joined at their lower ends to form a sheath in said narrow slot and in contiguous relation to all surfaces in said slot, (4) a coarse granular backfill material forming a liquid pervious filling in said sheath, said liquid pervious filling having a density greater than bentonite slurry used in forming said narrow slot and filling the entire space between said pair of flexible plastic sheets, and (5) means in said sheath for draining the liquid pervious filling, including pump means for draining said coarse granular backfill material.

2. A method of constructing an underground fluid barrier comprising:

excavating a trench in a direction along the desired line of said barrier in the presence of a bentonite slurry, said trench having a pair of facing sidewalls and a bottom, and installing a flexible impervious envelope formed of plastic sheeting in said trench, said impervious envelope having surfaces adjacent each of said pair of facing walls and along said bottom of said trench ans constituting a trench lining material, and, backfilling the complete space between said lining material in said envelope with a filling material having a density greater than bentonite to displace said bentonite slurry in said trench in a selected direction by movement of said lining material.

3. The method defined in claim 2 wherein said backfilling material is a pervious coarse granular material which in bulk, is surrounded on at least the bottom and sides thereof by said lining material and, as said backfilling material is installed, displaces said bentonite slurry in said direction of excavating.

4. A method of constructing an underground pollution control barrier comprising:

excavating a trench along the desired line of said pollution control barrier in the presence of a bentonite excavation slurry, installing a plastic sheath in said trench, said plastic sheath being comprised of a pair of impervious plastic layers imperviously joined at their lower most ends and opened at the top and of sufficient vertical extent to extend above the ground surface on both sides of said trench, as said plastic sheath is installed in said trench, backfilling the entire space between the two facing surfaces of said pair of impervious plastic layers with a liquid pervious backfilling material to sink the joined lowermost ends of said pairs of impervious plastic layers to the bottom of said trench and displace the bentonite slurry forward in the trench toward the end being excavated and reduce the amount of bentonite needed for the excavation and installing a liquid draining means to drain said liquid pervious backfilling material, whereby said underground pollution control barrier is constituted by the areas of the two earth sidewalls of the trench, each sidewall being permeated by bentonite and having bentonite cake contiguous thereto, an impervious plastic layer and the backfill material between the facing surfaces of said plastic layers.

5. An underground pollutant barrier in the earth comprising, in combination, a spaced apart pair of impervious plastic sheets forming a plastic sheath in the earth with one of said pair of impervious plastic sheets facing a source of liquid pollutant, a liquid pollutant pervious layer of coarse granular material encased in said plastic sheath between said plastic sheets said liquid pollutant pervious layer filling the complete source between said spaced apart pair of impervious plastic sheets, and pump means for draining liquid pollutants which penetrate said one of said pair of impervious plastic layers from said coarse granular material.

* * * * *